US005944564A

United States Patent [19]

Chadbourne et al.

[11] Patent Number: 5,944,564

[45] Date of Patent: Aug. 31, 1999

[54] ELECTRICAL WEDGE CONNECTOR WITH INSULATION PIERCING WEDGE AND PROTECTIVE FLAPS

[75] Inventors: Richard Chadbourne, Merrimack; William J Lasko, Littleton; Armand T Montminy, Manchester, all of N.H.

[73] Assignee: Framatome Connectors USA Inc., Fairfield, Conn.

[21] Appl. No.: 09/123,685

[22] Filed: Jul. 28, 1998

[51] Int. Cl.[6] ..... H01R 4/50

[52] U.S. Cl. ..... 439/783

[58] Field of Search ..... 439/781–783, 439/863

[56] References Cited

U.S. PATENT DOCUMENTS

| | | | |
|---|---|---|---|
| 2,801,400 | 7/1957 | Noirclerc | 439/783 |
| 4,415,222 | 11/1983 | Polidori . | |
| 5,679,031 | 10/1997 | Chadbourne et al. | 439/783 |
| 5,820,422 | 10/1998 | Chadbourne et al. | 439/783 |
| 5,842,893 | 12/1998 | De Keyser | 439/783 |

FOREIGN PATENT DOCUMENTS

| | | | |
|---|---|---|---|
| 0017049 | 10/1980 | European Pat. Off. | 439/783 |
| 0810688 | 12/1997 | European Pat. Off. . | |
| 2065994 | 7/1981 | United Kingdom . | |

OTHER PUBLICATIONS

Malico Catalog, "Waterproof Insulation Piercing ABC Connector", pp. 5.2 and 5.3, Oct. 1994.

Malico Catalog, "Anchoring Clamp Malicro Type", p. AS.4, Jun. 1995.

*Primary Examiner*—Steven L. Stephan
*Assistant Examiner*—Javaid Nasri
*Attorney, Agent, or Firm*—Perman & Green, LLP

[57] ABSTRACT

An electrical wedge connector having a shell and a wedge. The wedge has a main body and flaps extending from the main body. Conductor receiving areas are formed between the flaps and the main body. The main body also has insulation piercers for piercing through electrical insulation on the conductors in the receiving areas.

18 Claims, 2 Drawing Sheets

ELECTRICAL WEDGE CONNECTOR WITH INSULATION PIERCING WEDGE AND PROTECTIVE FLAPS

BACKGROUND OF THE INVENTION

1. Field of the Invention

The present invention relates to electrical connectors and, more particularly, to an electrical wedge connector.

2. Prior Art

U.K. patent application publication No. GB 2065994 discloses an electrical wedge connector with an insulation piercing wedge. U.S. Pat. No. 5,679,031 discloses a wedge connector with retention barbs on its shell.

SUMMARY OF THE INVENTION

In accordance with one embodiment of the present invention, an electrical wedge connector is provided comprising a shell and a wedge. The wedge is sized and shaped to be inserted into the shell. The wedge comprises a main body with two conductor contact surfaces on opposite sides of the main body and at least one flap extending over a first one of the conductor contact surfaces at a first one of the sides. A gap is provided between the first conductor contact surface and the flap which receives an electrical conductor therein.

In accordance with another embodiment of the present invention, an electrical connector wedge is provided comprising a main body, a first movable flap, and means for piercing through electrical insulation of a first electrical conductor. The main body has two conductor contact surfaces on opposite sides of the main body. The first movable flap extends from the main body and is positionable over a first one of the conductor contact surfaces to form a pocket for receiving a first electrical conductor therein. The means for piercing is adapted to pierce through electrical insulation of the first electrical conductor and electrically contact an electrical conducting section of the first conductor.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
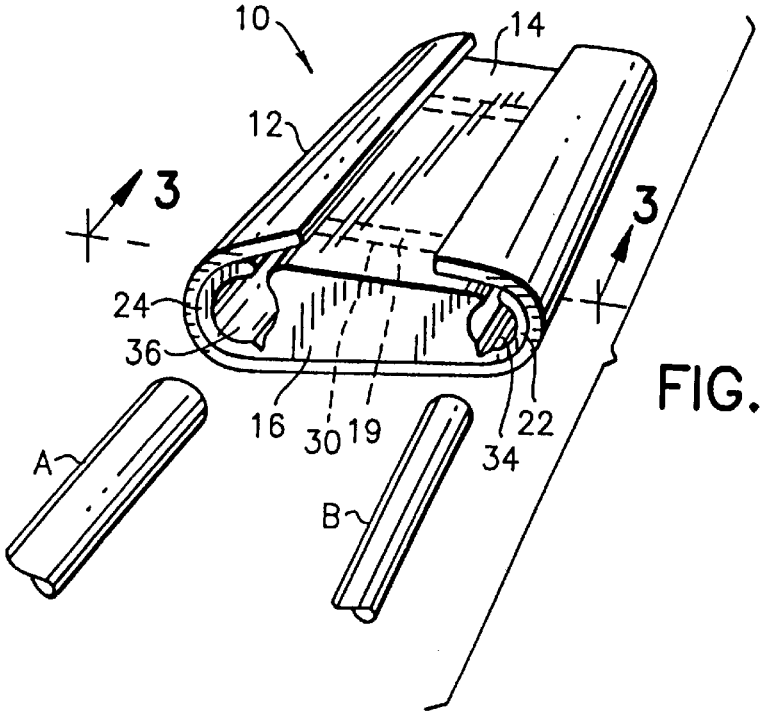
FIG. 1 is a perspective view of an electrical wedge connector incorporating features of the present invention and two electrical conductors shown in exploded view.

Referring to FIG. 1, there is shown an exploded perspective view of an electrical wedge connector 10 incorporating features of the present invention and two electrical conductors A,B. Although the present invention will be described with reference to the single embodiment shown in the drawings, it should be understood that the present invention can be embodied in many alternate forms of embodiments. In addition, any suitable size, shape or type of elements or materials could be used.

Figure 2:
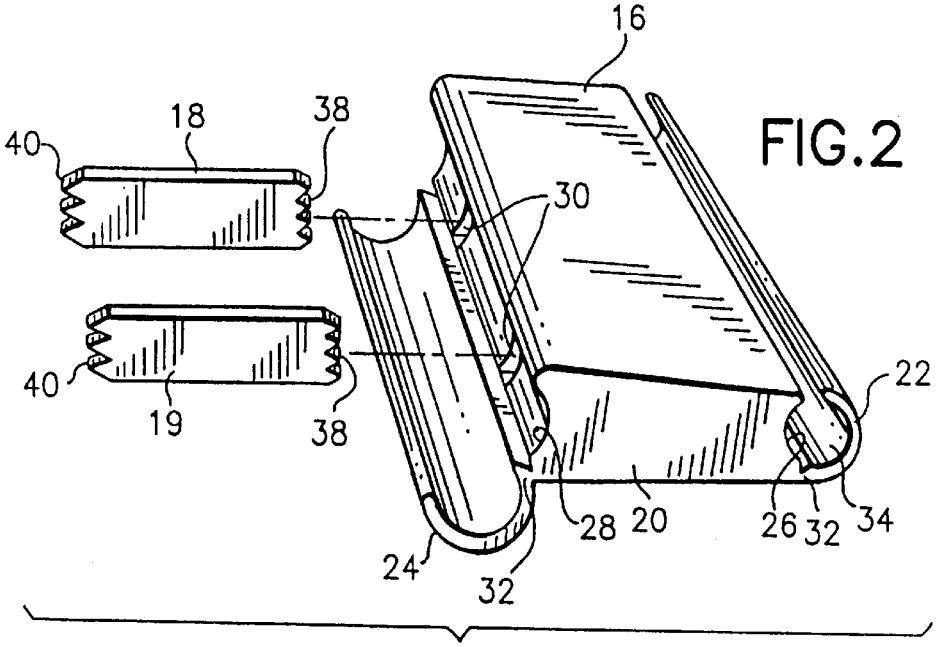
FIG. 2 is an exploded perspective view of the wedge assembly shown in FIG. 1.
Figure 3:
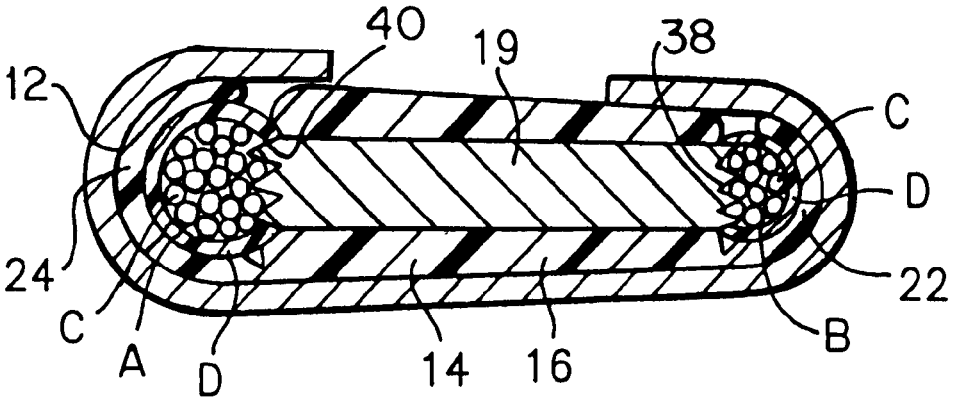
FIG. 3 is a cross-sectional view of the connector and conductors shown in FIG. 1 taken along line 3—3.

The connector 10 comprises a shell 12 and a wedge 14. The shell 12, in the embodiment shown, is a one-piece metal member with a general cross-sectional "C" shape and a general wedge shaped profile from front to rear. However, in alternate embodiments other types of wedge connector shells could be used. Referring also to FIGS. 2 and 3, the wedge 14 generally comprises a frame 16 and bars 18, 19. In this embodiment the frame 16 is comprised of dielectric material, such as molded plastic or polymer material. The frame 16 comprises a main body section 20 and two flaps 22, 24 on opposite side of the main body section 20. In an alternate embodiment more than two flaps could be provided or only one flap on one side of the main body section need be provided. The main body section 20 includes curved conductor contact surfaces 26, 28 and slots 30 extending between the surfaces 26, 28. The flaps 22, 24 are integrally formed with the main body section 20. However, in an alternate embodiment the flaps could be attached to the main body section rather than integrally formed therewith. In this embodiment a living hinge section 32 connects each of the flaps 22, 24 to the main body section 20. Thus, the flaps 22, 24 extend from the main body section 20 in a general cantilever fashion and can be moved relative to the main body section 20 at the living hinge sections 32. The flaps 22, 24 have a general cross-sectional semi-circular arc shape. The first flap 22 extends over the first conductor contact surface 26. The second flap 24 extends over the second conductor contact surface 28. Thus, two spaces or gaps 34, 36 are formed for receiving the conductors B,A therein, respectively.

The bars 18, 19 are substantially similar, except for their length, and are preferably comprised of electrically conductive metal. Opposite ends of the bars 18, 19 have insulation piercing teeth 38, 40. However, in alternate embodiments other types or numbers of electrically conductive members could be provided on the frame 16. In this embodiment the second flap 24 is folded back and the bars 18, 19 are inserted into the slots 30. In an alternate embodiment the frame 16 could be molded onto the bars 18, 19. The teeth 38, 40 extend out opposite ends of the slots 30 into the conductor receiving spaces 34, 36. The flaps 22, 24 can be folded back at their living hinge connections 32 to insert the conductors A, B into the gaps 36, 34. Then the wedge 14 and conductors A, B are inserted in the shell 12. The flaps 22, 24 protect the insulation D on the conductors A, B from being damaged by the shell 12 as the wedge is inserted into the shell. The flaps 22, 24 also push the conductors B, A against the teeth 38, 40 as the flaps are pushed in by the inward wedging action of the shell. The teeth 38, 40 are able to pierce through the insulation D on the conductors B, A and make direct electrical contact with the conductive sections C of the conductors. Thus, an electrical connection can be made between two insulated conductors by a wedge connector without first removing the electrical insulation layer and wherein the electrical connection is not made through the shell. However, in an alternate embodiment electrical connection could also be made through the shell.

Figure 4:
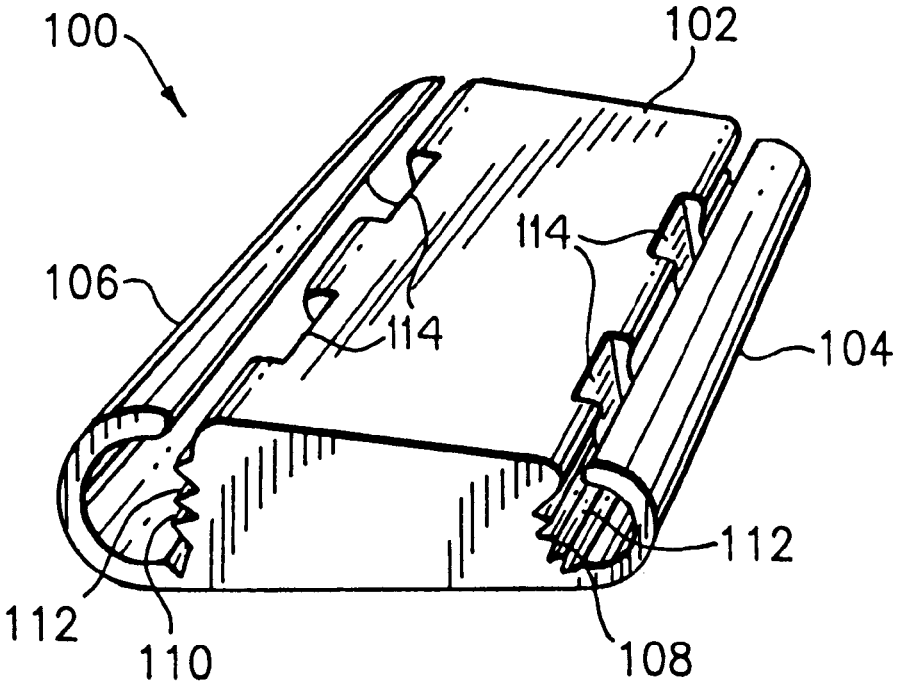
FIG. 4 is a perspective view of an alternate embodiment of the wedge.

Referring now to FIG. 4, an alternate embodiment of the wedge is shown. In this embodiment the wedge 100 is a one-piece member comprised of an electrically conductive material, such as aluminum. The wedge 100 has a main body 102 and two flaps 104, 106. The main body 102 has the two flaps 104, 106 formed integrally therewith, such as by means of an extrusion process. The main body 102 has two conductor contact surfaces 108, 110. The surfaces 108, 110 have teeth 112 therealong and recessed areas 114. The recessed areas 114 are provided to reduce the area of contact at the surfaces 108, 110 so that the teeth 112 can more easily pierce through insulation on the conductors. With this type of embodiment the wedge does not need separate insulation piercing members.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a shell; and a wedge which is sized and shaped to be inserted into the shell, the wedge comprising a main body and at least one flap, the main body having a general wedge shape with two conductor contact surfaces on opposite sides of the main body and the at least one flap extending from the main body over a first one of the conductor contact surfaces at a first one of the sides, wherein a gap is provided between the first conductor contact surface and the flap which receives an electrical conductor therein.

2. A wedge connector as in claim 1 wherein the main body is comprised of dielectric material.

3. A wedge connector as in claim 2 wherein the wedge further comprises electrical conducting bars mounted to the main body.

4. A wedge connector as in claim 3 wherein opposite ends of the bars have conductor insulation piercing teeth.

5. A wedge connector as in claim 1 wherein the flap is integrally formed with the main body and is movable relative to the main body at a living hinge connection between the main body and the flap.

6. A wedge connector as in claim 1 wherein the flap has a general semi-circular cross-sectional shape.

7. A wedge connector as in claim 1 wherein the wedge has two of the flaps, a second one of the flaps extending over a second one of the conductor contact surfaces at a second one of the sides.

8. A wedge connector as in claim 7 wherein the flaps extend in a cantilever fashion from the main body.

9. A wedge connector as in claim 7 wherein the wedge further comprises insulation piercers at the conductor contact surfaces for piercing through insulation of electrical conductors.

10. A wedge connector as in claim 9 wherein the insulation piercers are formed integrally on the conductor contact surfaces.

11. A wedge connector as in claim 10 wherein the main body and flaps are comprised of a one-piece member made of electrically conductive material.

12. A wedge connector as in claim 9 wherein the insulation piercers are electrically conductive members connected to the main body.

13. A wedge connector as in claim 12 wherein the main body is comprised of dielectric material which is molded onto the electrically conductive members.

14. An electrical connector wedge comprising:

a main body having a general wedge shape and two conductor contact surfaces on opposite sides of the main body;

a first movable flap extending from the main body, the first flap being positionable over a first one of the conductor contact surfaces to form a pocket for receiving a first electrical conductor therein; and means, extending into the pocket, for piercing through electrical insulation of the first electrical conductor and electrically contacting an electrical conducting section of the first conductor.

15. A wedge as in claim 14 wherein the main body and first movable flap are integrally formed with each other.

16. A wedge as in claim 14 further comprising a second movable flap extending from the main body over a second one of the conductor contact surfaces.

17. A wedge as in claim 16 wherein outer surfaces of the flaps are curved to slide along inside curved surfaces of an electrical wedge connector shell.

18. A wedge as in claim 14 wherein the means for piercing comprises electrically conductive members connected to the main body, and wherein the main body is comprised of dielectric material.

* * * * *